US008887759B1

(12) United States Patent
Cole

(10) Patent No.: US 8,887,759 B1
(45) Date of Patent: Nov. 18, 2014

(54) BUBBLE TOP

(76) Inventor: Warren G. Cole, Chattanooga, TN (US)

( * ) Notice: Subject to any disclaimer, the term of this patent is extended or adjusted under 35 U.S.C. 154(b) by 987 days.

(21) Appl. No.: 12/960,680

(22) Filed: Dec. 6, 2010

Related U.S. Application Data

(60) Provisional application No. 61/285,074, filed on Dec. 9, 2009.

(51) Int. Cl.
*B05B 17/08* (2006.01)
*B05B 1/02* (2006.01)
*G09F 13/24* (2006.01)

(52) U.S. Cl.
USPC ..... 137/563; 137/565.34; 137/565.37; 40/407; 40/408; 40/409

(58) Field of Classification Search
USPC ..... 137/563, 565.17, 565.34, 565.37; 40/406, 407, 408, 409
See application file for complete search history.

(56) References Cited

U.S. PATENT DOCUMENTS

| | | | | |
|---|---|---|---|---|
| 2,133,499 | A * | 10/1938 | Dolan | 40/408 |
| 3,807,357 | A * | 4/1974 | Hall | 119/269 |
| 5,571,409 | A * | 11/1996 | Scarborough | 210/167.25 |
| 6,152,381 | A * | 11/2000 | Hones | 239/17 |
| 7,861,942 | B2 * | 1/2011 | Damon et al. | 239/18 |
| 2008/0104869 | A1 * | 5/2008 | Wang | 40/406 |

OTHER PUBLICATIONS

Campbell, "Cole brings W.C. Gallery into the new year"; East Ridge & Brainerd Weekly, Dec. 24, 2008.

* cited by examiner

*Primary Examiner* — Craig Schneider
*Assistant Examiner* — Atif Chaudry
(74) *Attorney, Agent, or Firm* — Dan Shifrin

(57) ABSTRACT

A top for a table, desk, counter or the like includes a water-tight tank with a clear top surface. A mirror or other surface having dimensions less than the outer dimensions of the tank is positioned in the tank below the top. The tank is filled with a liquid to a level below the mirror such that air remains in the space between the top surface and the surface to the mirror. A pump discharges the liquid through tubes positioned around the perimeter of the tank in the space between the top surface and the surface of the mirror, causing bubbles to form and circulate in the space.

15 Claims, 5 Drawing Sheets

BUBBLE TOP

RELATED APPLICATION DATA

The present application claims benefit of U.S. Provisional Application Ser. No. 61/285,074, entitled BUBBLE TOP, filed on Dec. 9, 2009, which application is incorporated herein by reference in its entirety.

TECHNICAL FIELD

This invention relates generally to tops for tables, desks, counters and the like and, in particular, to water- and air-filled tops in which bubbles are formed and circulated for visual effect.

BACKGROUND ART

Tables, desks, counters and other like items typically have solid, unchanging top surfaces. Even when a glass top is placed over the top of a desk and photos inserted between the two, the result is visually static.

SUMMARY OF THE INVENTION

A visually dynamic top for a table, desk, counter or the like is provided and includes a watertight tank with a clear top surface. Preferably, a mirror or other surface having dimensions less than the outer dimensions of the tank is positioned below the top. The tank is filled with a liquid to a level below the mirror such that air remains above the level of the liquid, including above the surface to the mirror. A pump discharges the liquid through tubes positioned around the perimeter of the tank in the space between the clear top surface and the surface of the mirror, causing bubbles to form and circulate in the space.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
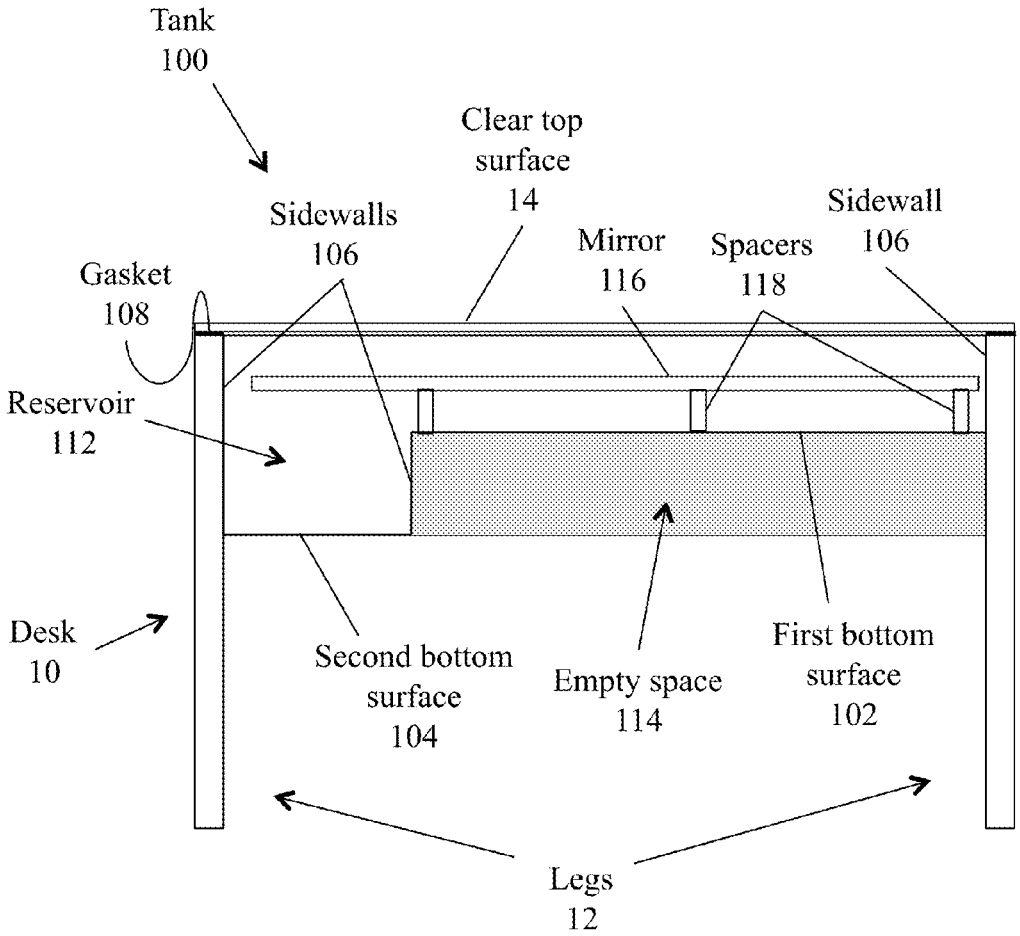
FIG. 1 is a side cross-sectional view of a desk incorporating an embodiment of a bubble top.

FIG. 1 is a side cross-sectional view of a desk 10 incorporating an embodiment of a bubble top. Although embodiments of the bubble top are described herein as being incorporated into a desk, embodiments may also be incorporated into a table, countertop or any other like furniture or structure. Furthermore, although embodiments of the bubble top are described and illustrated as being rectangular, the bubble top may also be any other regular geometric shape, such as, but not limited to, triangular, circular, oval, hexagonal, etc, or any irregular shape without affecting the scope of the claims.

Figure 2:
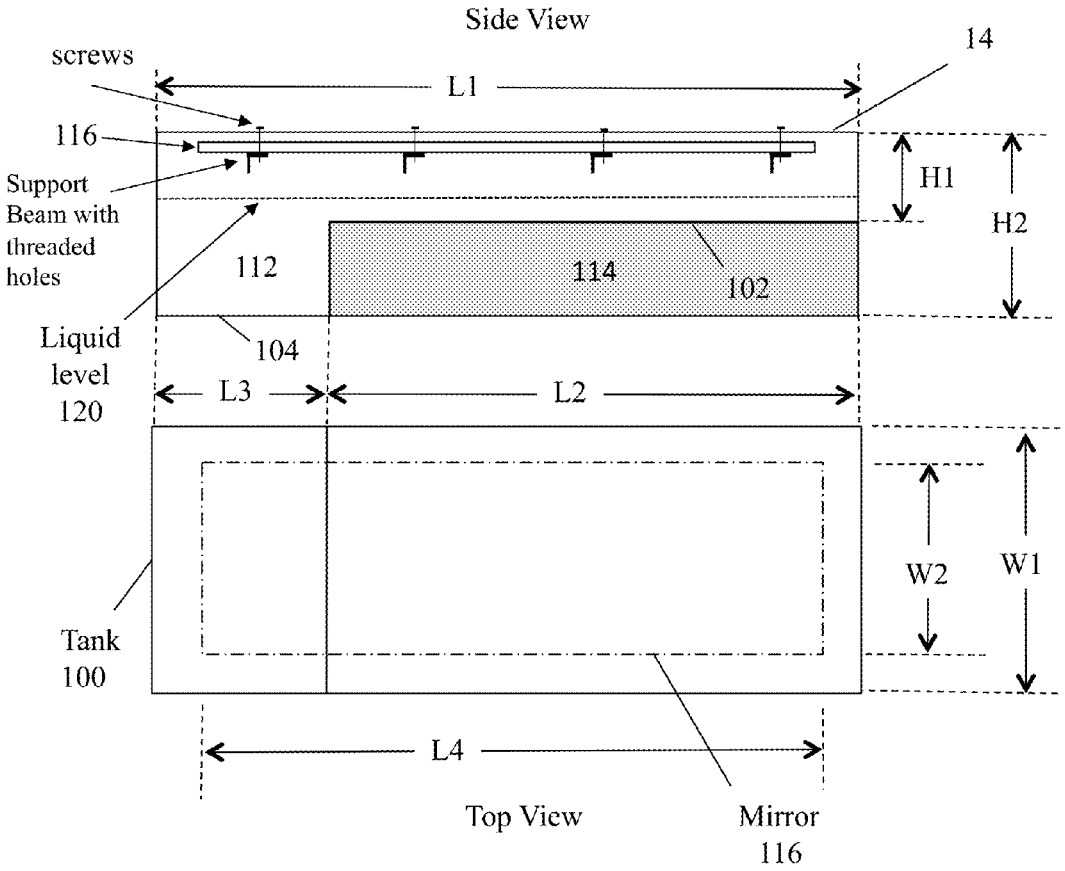
FIG. 2 is a side cross-sectional view and a top view of the bubble-top of FIG. 1.

As shown in FIG. 1, the desk 10 includes supporting legs 12 and a clear top surface 14, such as glass or acrylic. The top surface 14 has a length L1 and a width W1 (FIG. 2). A tank 100 is formed with a first bottom surface 102 positioned below the top surface 14 at a distance H1. The first bottom surface 102 has a length L2 along its parallel primary sides, which is less than L1, and a width W1 along its parallel secondary sides. A second bottom surface 104 is positioned below the top surface 14 at a distance H2 which is greater than H1 such that the second bottom surface 104 is below the first bottom surface 102. The length of the second bottom surface 104 is L1−L2=L3 and its width is W1. Sidewalls 106 connect the top surface 14 with the first and second bottom surfaces 102, 104 and connect the first bottom surface 102 with the second bottom surface 104. All seams or joints between the sidewalls 106 and the bottom surfaces 102, 104 and between adjacent sidewalls 106 are watertight, such as may be formed by welding although various other methods may be used to join the components, depending upon the materials used, among other factors. A gasket 108, such as formed with butyl caulk (although other material may be used), is positioned between the clear top 14 surface and the sidewalls 106. In one embodiment, a frame 110 runs around the top of the sidewalls 106 (FIG. 3); the gasket 108 may then be placed on top of the frame 110 and the top surface 14 secured to the frame 110 using decorative screws inserted through holes drilled through the top surface 14, thereby creating a watertight seal. Other means of securing the clear top surface 14 to the sidewalls 106 may also be used.

The volume enclosed by the top surface 14, the first and second bottom surfaces 102, 104 and the sidewalls 106 forms the watertight tank 100 while the volume formed by the second bottom surface 104 and the connecting sidewalls 106 creates a reservoir 112 for liquid within the tank 100. It will be appreciated that the material used for the bottoms 102, 104 and sidewalls 106 of the tank 100 should be sturdy, able to be joined in a watertight fashion and preferably be non-corrosive. Stainless steel is one such material; other materials may be used for different decorative effects.

The space beneath the first bottom surface 102 may be left open, or be partially enclosed with a floor, or be totally enclosed with a floor and sidewalls. In the FIGs., this space is referred to as "empty space" 114 and may be used to hold a water pump or a water pressure control valve as will be subsequently described.

Figure 3:
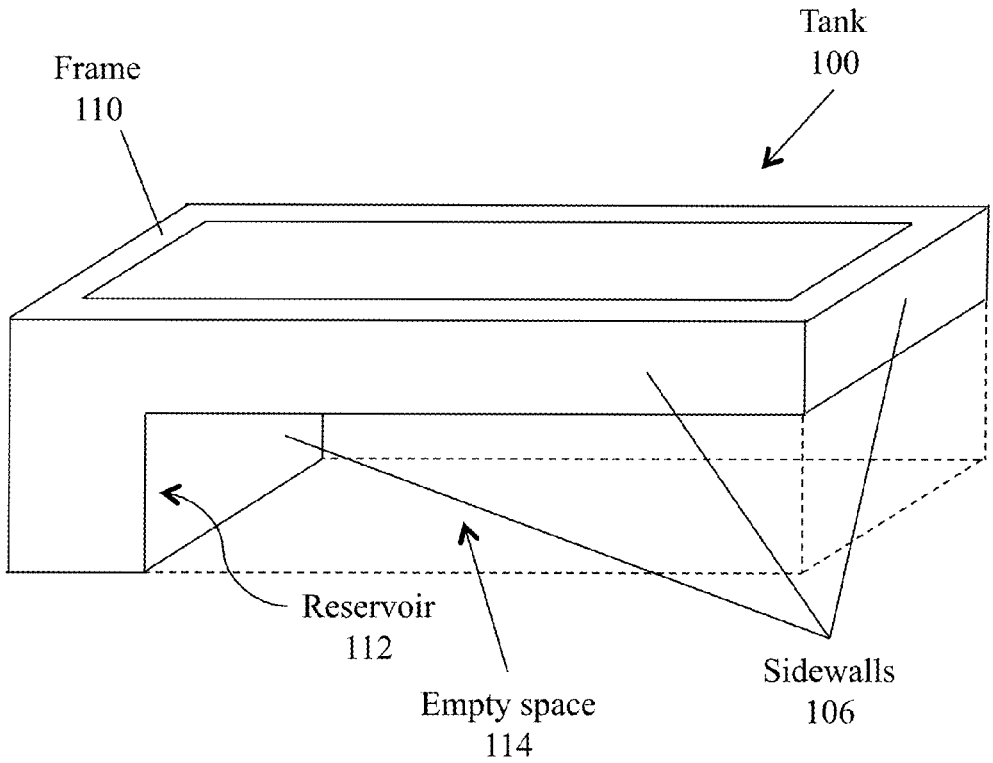
FIG. 3 is a perspective view of the tank of FIG. 1.
Figure 4:
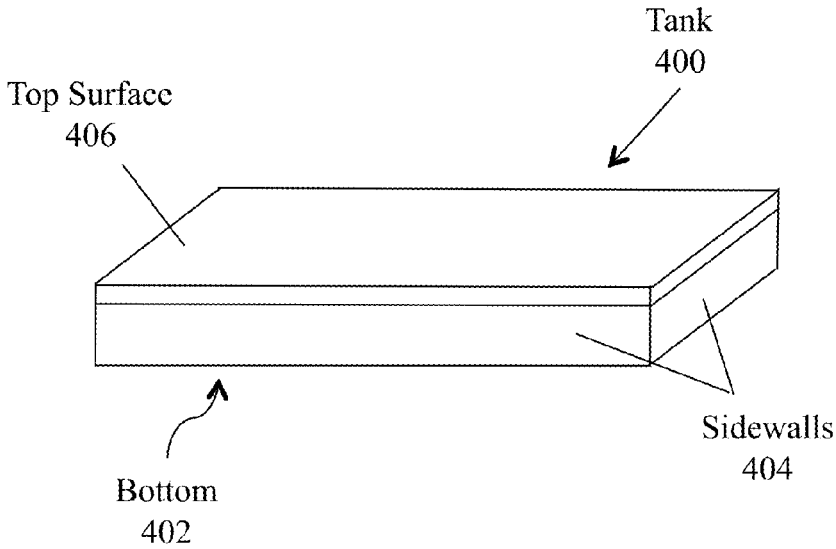
FIG. 4 is a perspective view of an embodiment of a bubble top tank without the reservoir area of the tank of FIG. 1.

FIG. 3 is a perspective view of the tank 100 of FIGS. 1 and 2 with the frame 110 in place. FIG. 4. Is a perspective view of another embodiment of a bubble top with a tank 400 that does not include a reservoir area. As with the tank 100 having a reservoir 112, the tank 400 includes a bottom 402, two pairs of spaced-apart parallel sidewalls 404 and has a clear top surface 406 secured to the tops of the sidewalls 404. As also with the tank 100, the water pump used with the tank 400 may be located beneath the tank 400 or may be a submersible pump placed within the tank 400.

Referring again to FIGS. 1 and 2, an intermediate horizontal surface, such as a mirror 116, may be positioned between the top surface 14 and the first bottom surface 102 to enhance the visual effect of the bubbles within the tank 110. The mirror 116 has a length L4 and width W2 which are less than the length and width of the top surface 14, as illustrated in FIG. 2. In one embodiment, the mirror 116 is positioned approximately ¼ inch below the bottom of the top surface 14. In the embodiment illustrated in FIG. 1, the mirror 116 is secured to the first bottom surface 102 using, for example, spacers 118 (three of which are shown in the FIG.). In an alternate embodiment (not illustrated), foam may be secured to the underside of the mirror 116 to allow the mirror 116 to float in place on the liquid. In still another embodiment (illustrated in FIG. 2), the mirror 116 is surrounded by the frame 110 (such as stainless steel). The frame 110 includes spaced apart tabs or angled support beams 120, with spacers if necessary, whose locations correspond to the screw holes in the clear top surface 14. When installed, the mirror 116 is securely suspended below the clear top surface 14. If the length and width of the mirror 14 are greater than the opening formed by the sidewall frame 110, the tabs or beams 120 will be concealed by the frame 110. It will be appreciated that other means of installing a mirror 116 may be used. It will also be appreciated that different materials may be used instead of a mirror to produce other visual effects.

If desired, trim may be applied to the top or underside of the top surface 14 to further conceal the screws, the frame 110, welding and water nozzles. Vinyl sticker trim is one type of trim that may be used. With a waterproof adhesive, the vinyl trim will remain secure when applied to the underside of the top surface 14. Other materials may also be used.

As also illustrated in FIG. 2, the tank 100 may be filled with a liquid 120 to a level below the mirror 116, preferably leaving at least about 1 inch of air space between the liquid 120 and the top surface 14. A drain valve (not shown) may be secured to the tank 100 in an appropriate location to allow easy draining of the liquid 120. A water pressure control valve (not shown) may be used to adjust the pressure of the circulating liquid 120 in order to manipulate the formation, size and motion of the bubbles as desired.

Figure 5:
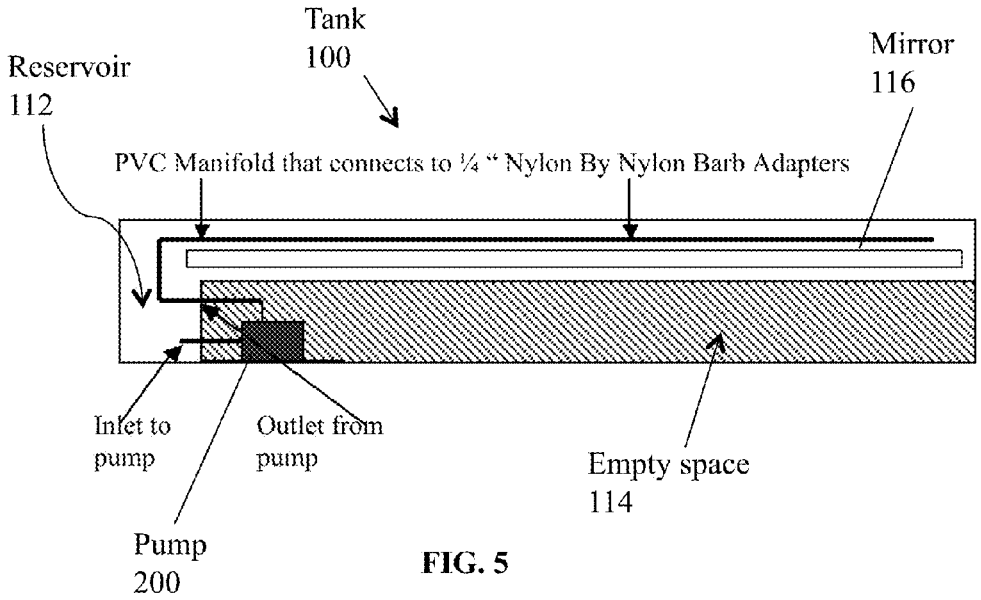
FIG. 5 is a side cross-sectional view of the bubble-top of FIG. 1 illustrating one possible arrangement of the plumbing.
Figure 6:
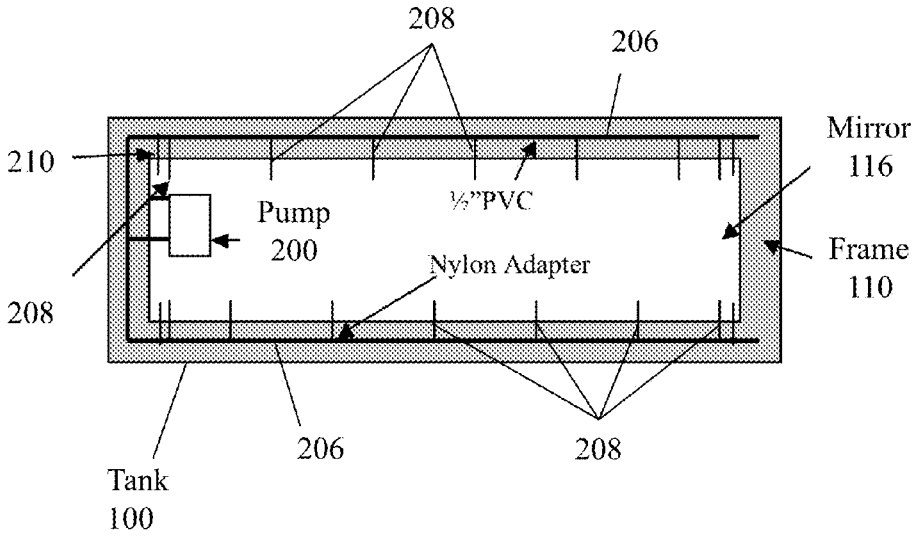
FIG. 6 is a top view of the bubble-top of FIG. 5.

The plumbing will now be described with reference to FIGS. 5 and 6. The desk unit 10 includes a water pump 200 which may be submersible or non-submersible. The illustrated embodiment shows a non-submersible pump secured to the floor of the empty space 114 beneath the first bottom surface 102 (FIG. 5). Inlet and outlet tubes 202, 204 extend into the reservoir 112 through the adjacent sidewall 106 in a watertight manner. The outlet 204 is connected to a set of tubes (manifolds) 206 which may be PVC or other suitable material and which extend along the two longer (primary) sides of the inside of the tank 100 above the first bottom surface 102 and, if a mirror 116 is installed, also above the mirror 116 and outside its perimeter (FIG. 6). In one embodiment, the manifolds 206 are ½ inch diameter PVC tubing.

Each of the two manifolds 206 has a set of openings facing the inside of the tank 100 through which the liquid 120, pumped by the pump 200, is discharged. Preferably, a smaller diameter of discharge tubing 208, such as ⅛ inch to ¼ inch diameter, is used and may be connected to the manifolds 206 by such connectors as Nylon barb adapters. If necessary, the discharge tubing 208, which may be Nylon, is flattened on one end to fit in the space between the top surface 14 and the mirror 116 and inserted into between the two materials. These discharge tubes 208 are used to direct the liquid 120 into the space between the top surface 14 and the mirror 116 and create bubbles which move around within the space. It has been found that spacing the tubing 208 about 10 to 12 inches apart produces an adequate number of bubbles and satisfactory liquid and bubble disbursement. In addition, the tubes 208 on one side of the tank 100 are preferably offset from the discharge tubes 208 on the other side (as illustrated in FIG. 5), resulting in better liquid and bubble disbursement. A pump rate of approximately 575 gallons per hour (gph), the use of twelve discharge tubes 208 and a discharge rate of approximately 48 gph from each of the tubes 208 produces a visually pleasing combination of the number, size and motion of bubbles. The pump rate, the number and diameter of discharge tubes 208 and discharge rate may be varied to produce other effects. Moreover, either or both of the pump and discharge rates need not be fixed at the time of manufacture but may be adjusted with user- or computer-controlled valves to provide a variety of static or changing effects.

Additionally, to avoid stagnant air gaps of the bubbles in the corners of the tank 100, four additional tubes 210 are preferably connected to the manifolds 206 in the corners (again, as illustrated in FIG. 5) through low pressure (approximately 10 gph) regulators. These additional tubes 210 may have a diameter of approximately ⅛ inch. Other configurations of tubes 208, 210 may also be used to create different visual effects (such as tubes on all four sides or on only one side of the tank, for example) or to accommodate tanks having shapes other than the rectangular shape described herein When the pump 200 is turned on, the liquid 120 is discharged through the tubes 208, 210 and floods the mirrored surface 116. Because of the small space between the top surface 14 and the top of the mirror 116, and the amount of liquid 120 being pumped into the space, the liquid 120 "sticks" to both surfaces. The air within the small space becomes mixed with the discharged liquid 120 forming air bubbles within the space. The bubbles circulate within the space and either re-circulate or float out of the space. The liquid 120 either drains off of the surface of the mirror 116 or re-circulates within the space due to the constant discharge of the liquid 120. This phenomenon creates a novel visual effect.

Although the liquid 120 used to fill the tank may be ordinary tap water, it is preferable that distilled water be used to prevent the build up of sediment. A small amount of bleach may be added to the water to reduce the growth of mold. Approximately ½ oz. of bleach in the tank 100 has been found to be sufficient. An algaecide (such as Fountec) may also be added to reduce or prevent algae and bacteria growth. And, a softener (such as Protec) may be added to the water to adjust the surface tension of the water and establish the size of the bubbles. It will be appreciated that other additives, dyes and liquids may be used for varying effects and pollution control. It will also be appreciated that different types of pumps may be used to accommodate different liquids.

Figure 7A:
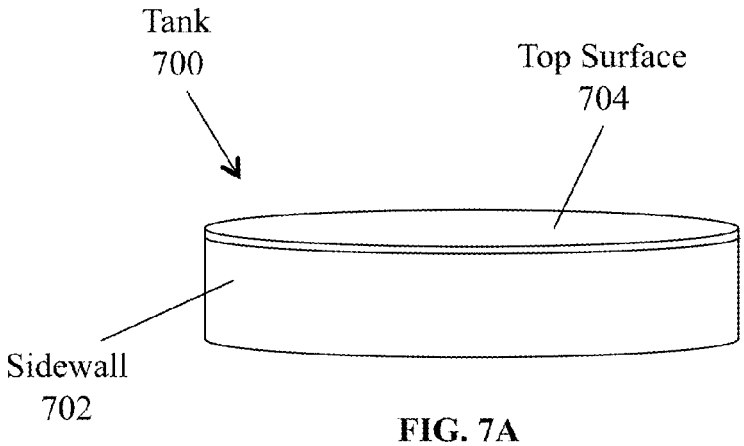
FIGS. 7A and 7B are perspective and top views, respectively, of a cylindrical-shaped bubble top tank.
Figure 7B:
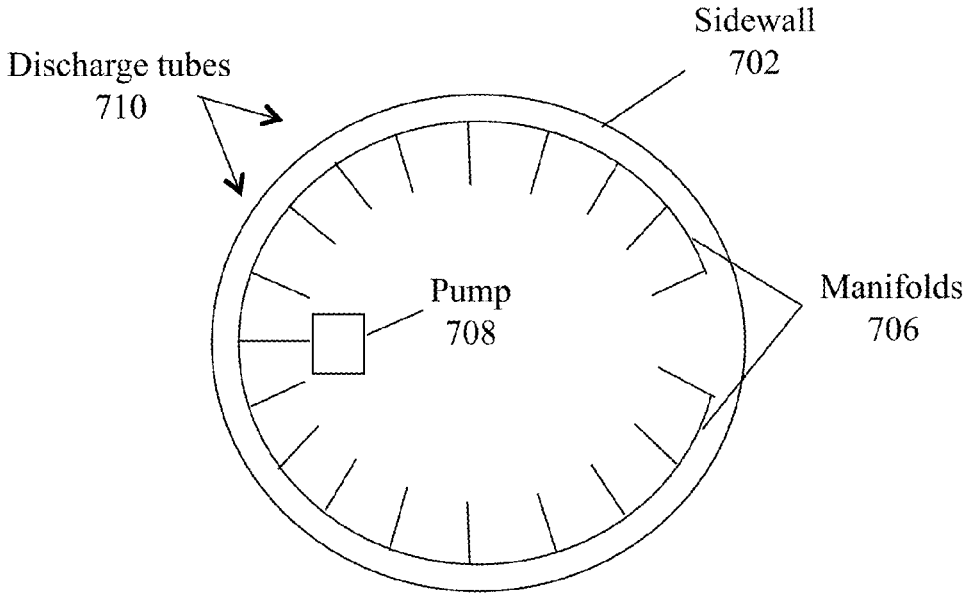

As previously noted, the scope of the invention is not limited to the rectangular box-shaped tank illustrated in FIGS. 1-6. The tank may be any other regular geometric shape or even an irregular shape. FIGS. 7A and 7B are perspective and top views, respectively, of one such alternative in which the tank 700 is cylindrical having a single sidewall 702 and a clear top surface 704 secured to the top of the sidewall 702. As with the embodiment illustrated in FIGS. 5 and 6, manifold tubes 706 adjacent to the sidewall 702 around the perimeter of the tank 700 are coupled to a pump 708 and horizontal discharge tubes 710 are coupled perpendicularly to the manifold tubes 706. Additional or other tubing may be used to achieve different visual effects.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A bubble top, comprising:

a water-tight tank, comprising:

clear top surface having a width W1 and a length L1;

a first bottom surface separated from the top surface by a first height H1, the first bottom surface having first and second parallel primary sides each with a length L2 and first and second parallel secondary sides each with a length W1, L2 being less than L1;

a second bottom surface separated from the top surface by a second height H2 greater than H1, the second bottom surface having a width W1 and a length L3=L1−L2;

a first set of sidewalls connecting the top surface with the first bottom surface;

a second set of sidewalls connecting the top surface with the second bottom surface; and a third set of sidewalls connecting the first bottom surface with the second bottom surface;

whereby the second bottom surface and second and third sets of sidewalls form a reservoir;

a water pump having:

an inlet coupled to receive liquid from the reservoir; and an outlet to force the liquid into the tank;

first and second tubes, each coupled to the outlet of the water pump, the first tube extending horizontally between the top surface and the first bottom surface and adjacent the first primary side;

the second tube extending horizontally between the top surface and the first bottom surface and adjacent the second primary side;

first and second pluralities of third tubes, through which water is ejected into the space between the top and bottom surfaces, the first plurality of third tubes being coupled to spaced-apart openings in the first tube and extending horizontally between the top surface and the first bottom surface perpendicular to the first tube; and the second plurality of third tubes being coupled to spaced-apart openings in the second tube and extending horizontally between the top surface and the first bottom surface perpendicular to the second tube;

the reservoir and a lower portion of the space below the top surface and first bottom surface being fillable with the liquid whereby, when the pump is activated, the liquid is pumped from the reservoir through the first and second tubes and out ends of the first and second pluralities of third tubes into a space between the top surface and first bottom surface, whereby further bubbles are formed and move within the space between the top surface and first bottom surface.

2. The bubble top of claim 1, wherein the second plurality of third tubes extending from the second tube are offset from the first plurality of third tubes extending from the first tube.

3. The bubble top of claim 2, further comprising a plurality of fourth tubes having a diameter less than a diameter of the plurality of third tubes and ejecting liquid at a pressure less than a pressure at which liquid is ejected form the plurality of third tubes, the plurality of fourth tubes comprising:

a first fourth tube extending from an opening at a first end of the first tube and extending horizontally between the top surface and the first bottom surface perpendicular to the first tube;

a second fourth tube extending from an opening at a second end of the first tube and extending horizontally between the top surface and the first bottom surface perpendicular to the first tube;

a third fourth tube extending from an opening at a first end of the second tube and extending horizontally between the top surface and the first bottom surface perpendicular to the second tube; and a fourth tube extending from an opening at a second end of the second tube and extending horizontally between the top surface and the first bottom surface perpendicular to the second tube.

4. The bubble top of claim 3, wherein the pressure of the liquid ejected from the fourth tubes is approximately 10 gallons per hour (gph).

5. The bubble top of claim 1, wherein a diameter of the first and second tubes is approximately ½ inch and a diameter of the plurality of third tubes is approximately ¼ inch.

6. The bubble top of claim 1, wherein the first plurality of third tubes are spaced in the range of 10 to 12 inches apart and the second plurality of third tubes are spaced in the range of 10 to 12 inches apart.

7. The bubble top of claim 1, wherein the liquid comprises water and at least one of an algaecide, a softener, and bleach.

8. The bubble top of claim 1, further comprising an intermediate surface having a length L4 and a width W2 less than W1 spaced between the top surface and the second bottom surface.

9. The bubble top of claim 8, wherein the intermediate surface is spaced approximately ¼ inch below the top surface.

10. An apparatus, comprising:

a water-tight tank having a bottom and sidewalls secured to the bottom enclosing a volume of the tank;

a clear top surface positioned on top of the sidewalls of the tank;

a horizontal intermediate surface positioned within the tank below the top surface and above a liquid-level of the tank, the intermediate surface having dimensions less than dimensions of the top surface;

a pump having:

an inlet coupled to receive liquid from the tank; and an outlet; and a first tube coupled to the outlet of the pump and extending horizontally between the top surface and the intermediate surface adjacent the sidewalls and having spaced-apart openings facing the inside of the tank;

whereby, when the tank is filled with the liquid to the liquid-level and the pump is activated, the liquid is pumped from the tank through the first tube and discharged from the openings into a space between the top surface and intermediate surface forming bubbles that move within the space.

11. The bubble top of claim 10, further comprising a plurality of second tubes coupled to spaced-apart openings in the first tube and extending horizontally between the top surface and the intermediate surface perpendicular to the sidewalls, whereby the liquid is pumped through the first tube and discharged into the space from the plurality of second tubes.

12. The bubble top of claim 10, wherein the sidewalls of the water-tight tank form a regular geometric shape.

13. The bubble top of claim 10, wherein the sidewalls of the water-tight tank form an irregular shape.

14. The bubble top of claim 10, wherein the liquid comprises water and at least one of an algaecide, a softener, and bleach.

15. The bubble top of claim 10, wherein the intermediate surface is positioned approximately ¼-inch below the top surface.

* * * * *